US007855710B2

(12) United States Patent
Ito

(10) Patent No.: US 7,855,710 B2
(45) Date of Patent: Dec. 21, 2010

(54) ELECTRO-OPTICAL DEVICE, CIRCUIT FOR DRIVING ELECTRO-OPTICAL DEVICE, METHOD OF DRIVING ELECTRO-OPTICAL DEVICE, AND ELECTRONIC APPARATUS

(75) Inventor: Akihiko Ito, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 928 days.

(21) Appl. No.: 11/245,076

(22) Filed: Oct. 7, 2005

(65) Prior Publication Data

US 2006/0087488 A1 Apr. 27, 2006

(30) Foreign Application Priority Data

Oct. 25, 2004 (JP) ..... 2004-309132
Aug. 5, 2005 (JP) ..... 2005-227566

(51) Int. Cl.
*G09G 3/36* (2006.01)

(52) U.S. Cl. ..... 345/103; 313/484; 345/89

(58) Field of Classification Search ..... 345/107
See application file for complete search history.

(56) References Cited

U.S. PATENT DOCUMENTS 5,038,139 A * 8/1991 Fujisawa et al. ..... 345/89
5,757,349 A * 5/1998 Togashi ..... 345/91
5,877,738 A * 3/1999 Ito et al. ..... 345/94
5,929,832 A * 7/1999 Furukawa et al. ..... 345/98
6,118,425 A * 9/2000 Kudo et al. ..... 345/100
6,900,788 B2 * 5/2005 Yamazaki ..... 345/103
6,985,130 B2 1/2006 Nakayoshi et al.
7,042,431 B1 5/2006 Washio et al.
7,164,403 B2 * 1/2007 Isami et al. ..... 345/89
2004/0080480 A1 * 4/2004 Zhang et al. ..... 345/90

FOREIGN PATENT DOCUMENTS

CN 1311502 A 9/2001
JP 2003-140626 5/2003
JP A-2003-255904 9/2003

* cited by examiner

*Primary Examiner*—Amare Mengistu
*Assistant Examiner*—Vinh Lam
(74) *Attorney, Agent, or Firm*—Oliff & Berridge, PLC

(57) ABSTRACT

A circuit for driving an electro-optical device, the electro-optical device having a plurality of scanning lines, a plurality of data lines divided into groups, each group having a predetermined number of data lines, and a plurality of pixels disposed to correspond to intersections of the plurality of scanning lines and the plurality of data lines, includes a scanning line driving circuit that selects each of the plurality of scanning lines for each selection period, the selection period including a plurality of data output periods, a plurality of image signal lines that correspond to the groups, a plurality of switching elements that switch between conductive states and non-conductive states of the data lines belonging to each group and the image signal lines corresponding to each group, a control circuit that sequentially switches the switching elements corresponding to each group to the conductive states for each data output period in the selection period, and a voltage output circuit that applies a voltage according to a gray-scale level of each pixel to each image signal line in each data output period of the selection period, and applies a predetermined voltage to each image signal line in a period after the last data output period of the selection period has lapsed.

9 Claims, 9 Drawing Sheets

Related Art

Related Art

Related Art

ELECTRO-OPTICAL DEVICE, CIRCUIT FOR DRIVING ELECTRO-OPTICAL DEVICE, METHOD OF DRIVING ELECTRO-OPTICAL DEVICE, AND ELECTRONIC APPARATUS

BACKGROUND

1. Technical Field

This application claims the benefit of Japanese Patent Application No. 2004-309132, filed Oct. 25, 2004 and Japanese Patent Application No. 2005-227566, Filed Aug. 5, 2005. The entire disclosure of the prior applications are hereby incorporated by reference herein in their entirety.

The present invention relates to a technology in which an electro-optical material is used to display images.

2. Related Art

An electro-optical device, which uses an electro-optical material, such as liquid crystal or the like, to display images, has been widely used. As a method of driving such an electro-optical device, for example, in JP-A-2003-255904, a driving method has been disclosed in which voltage signals (hereinafter, referred to as gray-scale signals) for defining gray-scale levels of a plurality of pixels in a time-division manner are output to be divided for the respective pixels. FIG. 11 is a circuit diagram showing the configuration of a part in respects to driving data lines in an electro-optical device which uses such a method. FIG. 12 is a timing chart showing the operation of the electro-optical device. As shown in FIG. 11, a plurality of data lines 13 are divided into groups G (G1, G2, . . . ) each group having three data lines 13, and the three data lines 13 belonging to each group G are connected to a common image signal line 53 via switching elements 151, such as thin film transistor (TFT) elements or the like. The gate electrodes of the respective switching elements 151 belonging to one of the groups G are connected to different sampling signal lines 51. To the sampling signal lines 51, as shown in FIG. 12, sampling signals S1 to S3, which sequentially become active levels in different periods (hereinafter, referred to as 'data output periods') Td, are supplied.

To each image signal line 53, the gray-scale signal dj (where j is a natural number) for defining the gray-scale levels of the respective pixels connected to the three data lines 13 belonging to one of the groups G is supplied. For example, as shown in FIG. 13, it is assumed that the pixels connected to the first and second data lines 13 of the three data lines 13 belonging to the group G1 are caused to display halftone (gray), while the pixels connected to the third data line 13 are caused to display black. In this case, as shown in FIG. 12, the gray-scale signal d1 supplied to the image signal line 53 of the group G1 has a voltage Vg corresponding to halftone in the first and second data output periods Td of the horizontal scanning period (1H), and has a voltage Vb corresponding to black in the third data output period Td. With this configuration, the three switching elements 151 corresponding to each group G are sequentially turned on in the respective data output periods Td by the sampling signals S1 to S3, and, a voltage of the gray-scale signal d1 at that time is output and correspondingly applied to the data lines 13 as data signals Xa1, Xb1, and Xc1.

However, in this configuration, when the pixels connected to a specified data line 13 belonging to each group G (for example, in the configuration of FIG. 1, the third data line 13 of each group G) and the pixels connected to other data lines 13 of the corresponding group G have different gray-scale levels from each other, the gray-scale levels of the pixels corresponding to the respective data lines 13 of the latter may have the gray-scale levels different from the original gray-scale levels. For example, in an electro-optical device which uses a normally white mode, it is assumed that the pixels of the third column of the group G1 (that is, one black vertical line is displayed with a gray background) are used. In this case, as shown in FIG. 13, the gray-scale levels of the respective pixels of the third column belonging to the group G1 are targeted to become black, and the gray-scale level of each of the pixels of the group G2 becomes expected halftone. However, each of the pixels of the first and second columns belonging to the group G1, which originally becomes halftone, is darker than halftone, unlike other pixels of the group G2. This difference between the gray-scale levels may be perceived by a user as display irregularity.

SUMMARY

An advantage of some aspects of the invention is that it causes pixels to display predetermined gray-scale levels with high precision, even when gray-scale levels of respective pixels connected to a plurality of data lines corresponding to a common image signal line are different from one another.

As shown in FIG. 11, parasitic capacitance C exists between the source electrode and the drain electrode of each switching element 151. The inventors have found that display irregularity shown in FIG. 13 is caused by parasitic capacitance C. This will be described below.

As shown in FIG. 12, the gray-scale signal d1, which is supplied to the image signal line 53, maintains the voltage Vg in the first and second data output periods Td, and becomes the voltage Vb just before the third data output period Td. The drain electrodes of three switching elements corresponding to one of the groups G1 are commonly connected to one image signal line 53. Accordingly, if the gray-scale signal d1 changes from the voltage Vg to the voltage Vb, the potential of the drain electrode of each of the first and second switching elements 151 belonging to the group G1 changes from the voltage Vg to the voltage Vb. Here, since the respective data lines 13 are capacitively coupled to the image signal line 53 via the switching elements 151, if the potential of the drain electrode of each of the switching elements 151 is changed to the voltage Vb, the voltage of each of the data lines 13 of the first and second columns is also changed (here, increased) by ΔV according to the change of the voltage. As such, since the voltage (a voltage higher than the original voltage Vg by ΔV) of the data line 13, which is changed according to the change of the gray-scale signal d1, is applied to the respective pixels, the gray-scale levels of the pixels of the first and second columns belonging to the group G1 are darker than the original gray-scale levels. In general, ΔV is determined by the ratio between parasitic capacitance C and capacitance of the data line 13. More specifically, as parasitic capacitance C is larger than capacitance of the data line 13, ΔV is proportionally increased. In general, as the pixels are made with higher definition, capacitance of the data line 13 is decreased, such that parasitic capacitance C is relatively increased and thus ΔV is also increased. For this reason, display irregularity due to parasitic capacitance C drastically exists in a small and high-definition electro-optical device, such as a display device used for a portable electronic apparatus or a light valve user for a projection-type display device. Moreover, as for the group G2 of which all the pixels display common halftone, the gray-scale signal d2 has the same potential over all the data output periods Td. Accordingly, a phenomenon that a voltage to be applied to the pixel is changed due to a change in voltage of the gray-scale signal d2 almost never occurs. As a result, the respective pixels of the group G2 have original halftone.

On the basis of the above-described knowledge, the invention has been achieved. According to a first aspect of the invention, there is provided a circuit for driving an electro-optical device, the electro-optical device having a plurality of scanning lines, a plurality of data lines divided into groups, each group having a predetermined number of data lines, and a plurality of pixels disposed to correspond to intersections of the plurality of scanning lines and the plurality of data lines. The circuit for driving an electro-optical device includes a scanning line driving circuit that selects each of the plurality of scanning lines for each selection period, the selection period including a plurality of data output periods, a plurality of image signal lines that correspond to the groups, a plurality of switching elements that switch between conductive states and non-conductive states of the data lines belonging to each group and the image signal line corresponding to each group, a control circuit that sequentially switches the switching elements corresponding to each group to the conductive states for each data output period in the selection period, and a voltage output circuit that applies a voltage according to a gray-scale level of each pixel to each image signal line in each data output period of the selection period, and applies a predetermined voltage to each image signal line in a period after the last data output period of the selection period has lapsed. According to this configuration, in the selection period, the predetermined potential is applied to the image signal line after the last data output period has lapsed. Therefore, even when the potential of each of the data lines corresponding to one group is changed due to the change in voltage of the image signal line, the data lines are adjusted to have a potential according to the predetermined potential in a stage after all the data output periods have lapsed. As a result, display quality is suppressed from being degraded due to the change in voltage of the image signal line. Moreover, in the invention, the predetermined potential is generally a potential which is selected in advance regardless of the gray-scale level of each pixel. For example, the predetermined potential may be a central voltage between an on voltage and an off voltage to be applied to the pixel (for example, a central voltage of a voltage for causing each pixel to display the highest gray-scale level and a voltage for causing each pixel to display the lowest gray-scale level).

In the circuit for driving an electro-optical device according to the first aspect of the invention, it is preferable that the voltage output circuit continue to apply the predetermined voltage to each image signal line even after each selection period has lapsed. According to this configuration, even when the selection of the scanning line by the scanning line driving circuit is temporarily delayed from an original timing, the voltage to be applied to the image signal line can be reliably maintained as the predetermined potential until the selection period lapses. Therefore, display irregularity can be reliably suppressed from occurring due to the change in voltage of the image signal line. Further, in the circuit for driving an electro-optical device according to the first aspect of the invention, it is preferable that the voltage output circuit make its output into a high impedance state in a period just before each data output period and in a period after the predetermined voltage is applied to the image signal line. According to this configuration, the voltage of the image signal line can be reliably set to an expected voltage in each data output period or in the period after the predetermined potential is applied.

Moreover, modes for grouping the data lines may be optionally performed. For example, the plurality of data lines may be divided into groups, each group having a plurality of adjacent data lines (first embodiment described below). Alternatively, one group may include the data lines belonging to a plurality of blocks (second embodiment described below).

According to a second aspect of the invention, an electro-optical device includes a plurality of scanning lines, a plurality of data lines that are divided into groups, each group having a predetermined number of data lines, a plurality of pixels that are disposed to correspond to intersections of the plurality of scanning lines and the plurality of data lines, a scanning line driving circuit that selects each of the plurality of scanning lines for each selection period, the selection period including a plurality of data output periods, a plurality of image signal lines that correspond to the groups, a plurality of switching elements that switch between conductive states and non-conductive states of the data lines belonging to each group and the image signal line corresponding to each group, a control circuit that sequentially switches the switching elements corresponding to each group to the conductive states for each data output period of the selection period, and a voltage output circuit that applies a voltage according to a gray-scale level of each pixel to each image signal line in each data output period of the selection period, and applies a predetermined voltage to each image signal line in a period after the last data output period of the selection period has lapsed. According to this configuration, like the circuit for driving an electro-optical device according to the first aspect of the invention, display irregularity can be suppressed from occurring due to capacitance existing in the switching element and the change in voltage of the image signal line.

The electro-optical device according to the second aspect of the invention is used as display devices for various electronic apparatuses. As described above, the smaller the electro-optical device is, the higher the influence by parasitic capacitance C of the switching element is increased. Therefore, the electro-optical device according to the second aspect of the invention is suitably used, in particular, for an electronic apparatus, such as a portable electronic apparatus or a projection-type display device.

The invention is specified as a method of driving an electro-optical device. That is, there is provided a method of driving an electro-optical device, the electro-optical device having a plurality of scanning lines, a plurality of data lines divided into groups, each group having a predetermined number of data lines, a plurality of pixels disposed to correspond to intersections of the plurality of scanning lines and the plurality of data lines, image signal lines that correspond to the groups of data lines, and a plurality of switching elements that switch between conductive states and non-conductive states of the data lines and the image signal lines. The method of driving an electro-optical device includes selecting each of the plurality of scanning lines for each selection period, the selection period having a plurality of data output periods, sequentially switching the switching elements corresponding to each group to the conductive states for each data output period of the selection period, and applying a voltage according to a gray-scale level of each pixel to each image signal line in each data output period of the selection period, and applying a predetermined voltage to each image signal line in a period after the last data output period of the selection period has lapsed. According to this configuration, like the circuit for driving an electro-optical device according to the first aspect of the invention, display irregularity is effectively suppressed from occurring due to capacitance existing in the switching element and the change in voltage of the image signal line.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
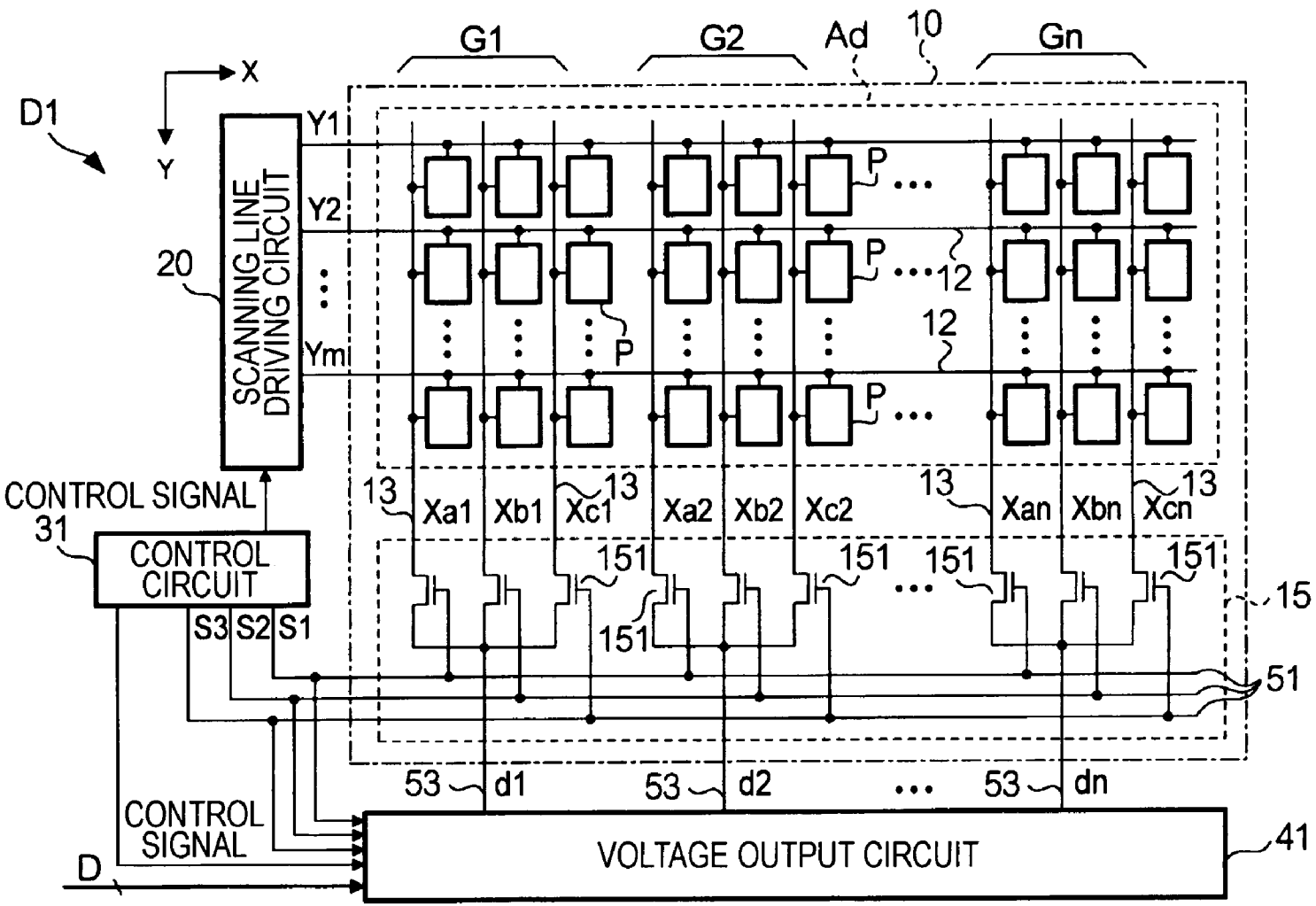
FIG. 1 is a block diagram showing a configuration of an electro-optical device according to a first embodiment of the invention.

First, an embodiment in which the invention is applied to an electro-optical device using liquid crystal as an electro-optical material will be described. FIG. 1 is a block diagram showing the overall configuration of the electro-optical device. As shown in FIG. 1, an electro-optical device D1 has an electro-optical panel 10, a scanning line driving circuit 20, a control circuit 31, and a voltage output circuit 41. Among these, the electro-optical panel 10 is a display panel in which liquid crystal is sealed in a gap between an element substrate and a counter substrate. The scanning line driving circuit 20, the control circuit 31, and the voltage output circuit 41 may be mounted on the electro-optical panel 10 or a wiring board bonded to the electro-optical panel 10 in forms of IC chips or may be directly incorporated into the surface of the element substrate of the electro-optical panel 10 with low-temperature silicon.

On the surface of the element substrate of the electro-optical panel 10, m scanning lines 12 extending in an X direction and 3n data lines 13 extending in a Y direction perpendicular to the X direction are formed (m and n are natural numbers). The data lines 13 are divided into n groups G1 to Gn, each group having three adjacent data lines 13. For example, the data lines 13 of the first to third columns from the left of FIG. 1 belong to the group G1, and the data lines 13 of the fourth to sixth columns belong to the group G2. Hereinafter, the j-th (where j is an integer satisfying the condition $1 \leqq j \leqq n$) group from the left in FIG. 1 is referred to as 'group Gj'.

Figure 2:
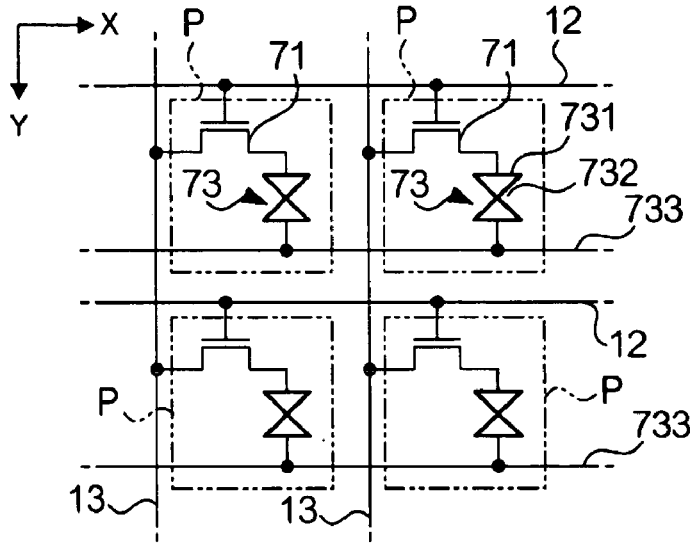
FIG. 2 is a circuit diagram showing a configuration of each pixel.

At intersections of the scanning lines 12 and the data lines 13, pixels P are disposed. Therefore, the pixels P are arranged in a matrix shape of m rows×3n columns in the X direction and the Y direction in a display region Ad. As shown in FIG. 2, one pixel P includes a switching element 71 and a pixel capacitor 73. Of these, the pixel capacitor 73 is constituted by a pixel electrode 731 formed on the element substrate, a counter electrode 733 formed on the counter substrate, and liquid crystal 732 interposed into a gap between the pixel electrode 731 and the counter electrode 733. On the other hand, the switching element 71 is a TFT element formed on the element substrate, for example. A gate electrode of the switching element 71 is connected to the scanning line 12, a source electrode thereof is connected to the data line 13, and a drain electrode thereof is connected to the pixel electrode 731. Moreover, a storage capacitor, which holds a voltage applied to liquid crystal 732, may be disposed in parallel with the pixel capacitor 73.

The scanning line driving circuit 20 is a circuit for sequentially selecting the m scanning lines 12. Specifically, the scanning line driving circuit 20 outputs scanning signals Y1, Y2, . . . , Ym, which sequentially become an active level for respective selection periods (horizontal scanning periods), to the respective scanning lines 12 (see FIG. 4). If the scanning signal Yi (where i is an integer satisfying the condition $1 \leqq i \leqq m$) becomes the active level, the i-th scanning line 12 is selected, the 3n switching elements 71 connected to the scanning line 12 are simultaneously turned on. At this time, voltages applied to the data lines 13 (that is, voltages of data signal Xaj, Xbj, and Xcj) are held in the pixel capacitors 73 of the respective pixels of the i-th row via the respective switching elements 71. Then, the alignment directions of liquid crystal 732 of the pixel capacitors 73 are changed according to the voltages, such that desired gray-scale display is performed. In the present embodiment, the electro-optical panel 10 is a normally-white-mode panel in which the gray-scale level of the pixel P when the voltage is not applied to the pixel capacitor 73 is white, and, as the voltage to be applied to the pixel capacitor 73 is increased, the gray-scale level becomes dark. However, a normally-black-mode panel may be used as the electro-optical panel 10.

Figure 4:
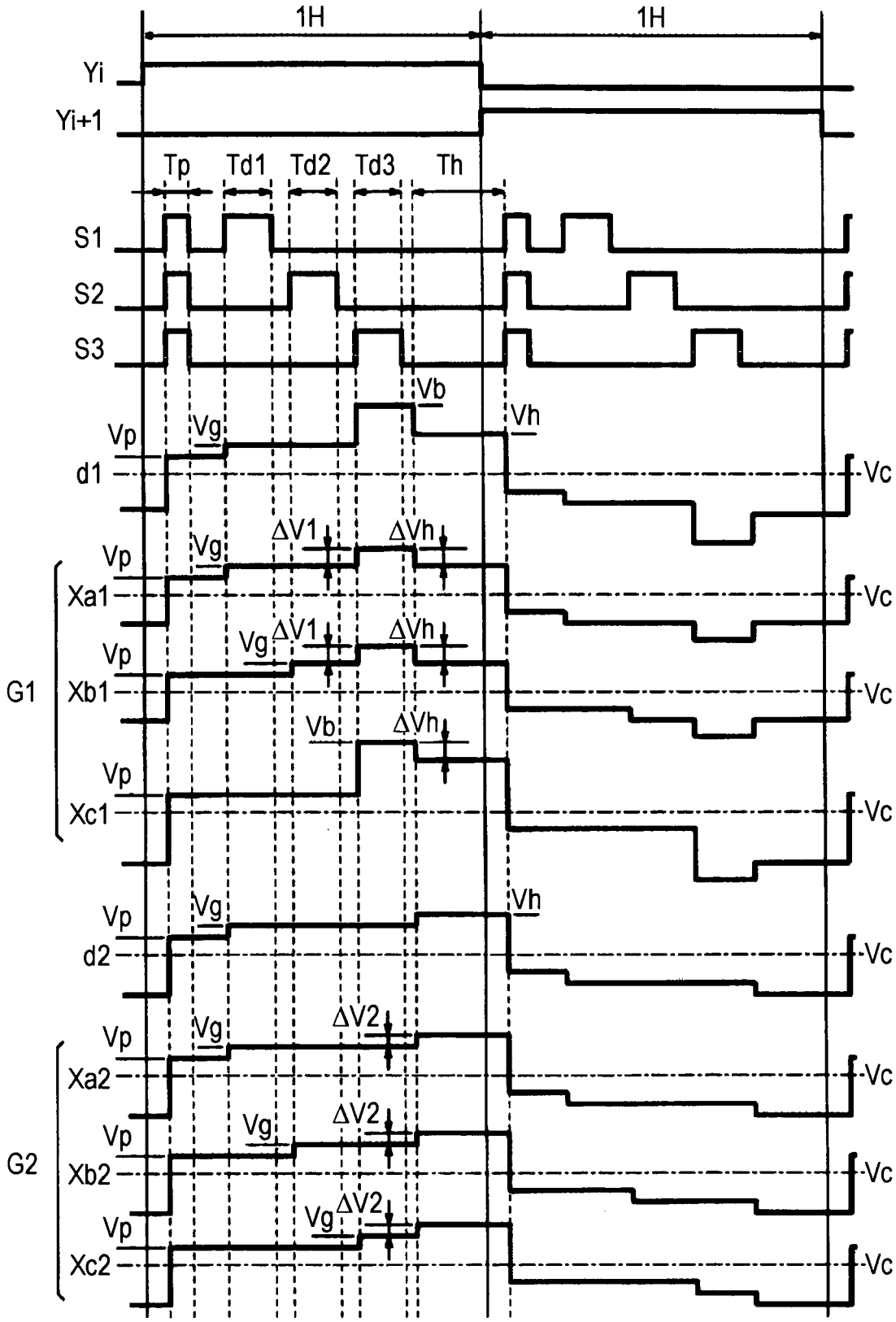
FIG. 4 is a timing chart illustrating an operation of the electro-optical device according to the first embodiment of the invention.

The control circuit 31 shown in FIG. 1 is a circuit that controls the overall operation of the electro-optical device D1. The control circuit 31 outputs control signals, such as clock signals and the like, to the scanning line driving circuit 20 or the voltage output circuit 41, and also generates sampling signals S1 to S3 so as to output them to sampling signal lines 51. Here, each selection period (1H) includes a precharge period Tp and three data output periods Td1 to Td3 corresponding to the number of data lines 13 belonging to one group Gj, as shown in FIG. 4. The data output periods Td are spaced apart from one another on the time axis. The sampling signals S1 to S3 output from the control circuit 31 simultaneously become the active level in the precharge period Tp of one selection period, and sequentially become the active level in the respective data output periods Td (Td1, Td2, and Td3) of the selection period. For example, the sampling signal S1 maintains the active level in the precharge period Tp and the first data output period Td1 of the selection period, and maintains an inactive level in other periods. Similarly, the sampling signal S2 becomes the active level in the precharge period Tp and the second data output period Td2, and the sampling signal S3 becomes the active level in the precharge period Tp and the third data output period Td3.

Figure 5:
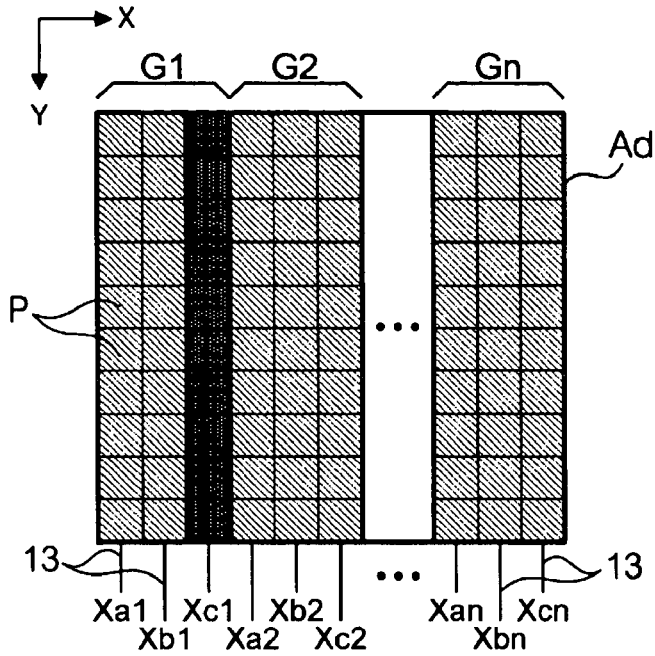
FIG. 5 is a plan view showing a display example by the electro-optical device.

The voltage output circuit 41 shown in FIG. 1 is a circuit that generates gray-scale signals d1 to dn corresponding to the groups G1 to Gn on the basis of gray-scale data D supplied from the outside in series and the sampling signals S1 to S3 output from the control circuit 31 to the sampling signal lines 51, and outputs the gray-scale signals d1 to dn to image signal lines 53, each of which is connected to the corresponding group Gj. Gray-scale data D is digital data that defines gray-scale levels of the respective pixels P. On the other hand, the gray-scale signal dj is a voltage signal that defines the gray-scale levels of the pixels P of three columns belonging to the group Gj in a time-division manner. Specifically, the gray-scale signal dj becomes a precharge voltage Vp in the precharge period Tp of the selection period in which the i-th scanning line 12 is selected (that is, the selection period in which the scanning signal Yi becomes the active level), and becomes a voltage according to gray-scale data Daj of the pixel P corresponding to the intersection of the i-th scanning line and the data line 13 of the first column belonging to the group Gj in the first data output period Td1, as shown in FIG. 4. In addition, the gray-scale signal dj becomes a voltage according to gray-scale data Dbj of the pixel P corresponding to the intersection of the i-th scanning line 12 and the data line 13 of the second column belonging to the group Gj in the second data output period Td2, and becomes a voltage according to gray-scale data Dcj of the pixel P corresponding to the intersection of the i-th scanning line 12 and the data line 13 of the third column belonging to the group Gj in the third data output period Td3. In FIG. 4, it is assumed that the pixels P of the first column and the second column belonging to the group G1 are caused to display halftone (gray) and the pixels P of the third column belonging to the group G1 are caused to display black, as shown in FIG. 5. In this case, the gray-scale signal d1 becomes a voltage Vg corresponding to halftone in the data output period Td1 and the data output period Td2, and becomes a voltage Vb corresponding to black at the start point of the data output period Td3, as shown in FIG. 4. In addition, the gray-scale signal dj becomes a voltage Vh in a period Th (hereinafter, referred to as 'voltage compensation period') from the end point of the last data output period Td3 of the selection period until the start point of the next selection period lapses. The voltage (hereinafter, referred to as 'compensation voltage') Vh is a voltage which is selected in advance regardless of the gray-scale levels of the respective pixels P. In the present embodiment, the voltage Vh is set to a central potential of a voltage for causing the pixel P to display white (the highest gray-scale level) and a voltage for causing the pixel P to display black (the lowest gray-scale level).

As shown in FIG. 1, in the element substrate of the electro-optical panel 10, a sampling circuit 15 is formed. The sampling circuit 15 has 3n switching elements 151 corresponding to different data lines 13. Each switching element 151 is a TFT element which is formed using the common process to the switching element 71 of the pixel P with the same material. Here, the configuration in which the sampling circuit 15 is directly formed in the element substrate has been exemplified, but the sampling circuit 15 may be integrated into the voltage output circuit 41 or the control circuit 31.

A drain electrode of each switching element 151 is connected to an end of the data line 13, and a source electrode thereof is connected to the image signal line 53 which is formed for each group Gj. That is, the three data lines 13 belonging to one group Gj are commonly connected to the image signal line 53, from which the gray-scale signal dj is output, via the switching elements 151. On the other hand, a gate electrode of each switching element 151 is connected to the sampling signal line 51. Specifically, the sampling signal S1 is supplied to the gate electrode of the first switching element 151 from the left of the three switching elements 151 corresponding to the group Gj, the sampling signal S2 is supplied to the gate electrode of the second switching element 151, and the sampling signal S3 is supplied to the gate electrode of the third switching element 151. Therefore, as shown in FIG. 4, in the precharge period Tp of each selection period (1H), all the switching elements 151 are simultaneously turned on, and a precharge voltage Vp of the gray-scale signal dj supplied to the image signal line 53 at that time is simultaneously applied to all the data lines 13. On the other hand, in the first data output period Td1 of each selection period, the switching element 151 of the first column belonging to each group Gj is turned on, and a voltage of the gray-scale signal dj supplied to the image signal line 53 at that time (that is, a voltage according to the gray-scale level of the pixel P corresponding to the intersection of the data line 13 of the first column and the currently selected scanning line 12) is applied to the data line 13 as the data signal Xaj. On the other hand, in the second data output period Td2, the switching element 151 of the second column belonging to each group Gj is turned on, and the gray-scale signal dj is supplied to the data line 13 connected to the switching element 151 as the data signal Xbj. Similarly, in the third data output period Td3, the switching element 151 of the third column belonging to each group Gj is turned on, the gray-scale signal dj is supplied to the data line 13 connected to the switching element 151 as the data signal Xcj. With this configuration, to the three data lines 13 of each group Gj, the data signals Xaj, Xbj, and Xcj according to the gray-scales levels of the pixels P connected to the data lines 13 are sequentially supplied in a time-division manner.

Figure 3:
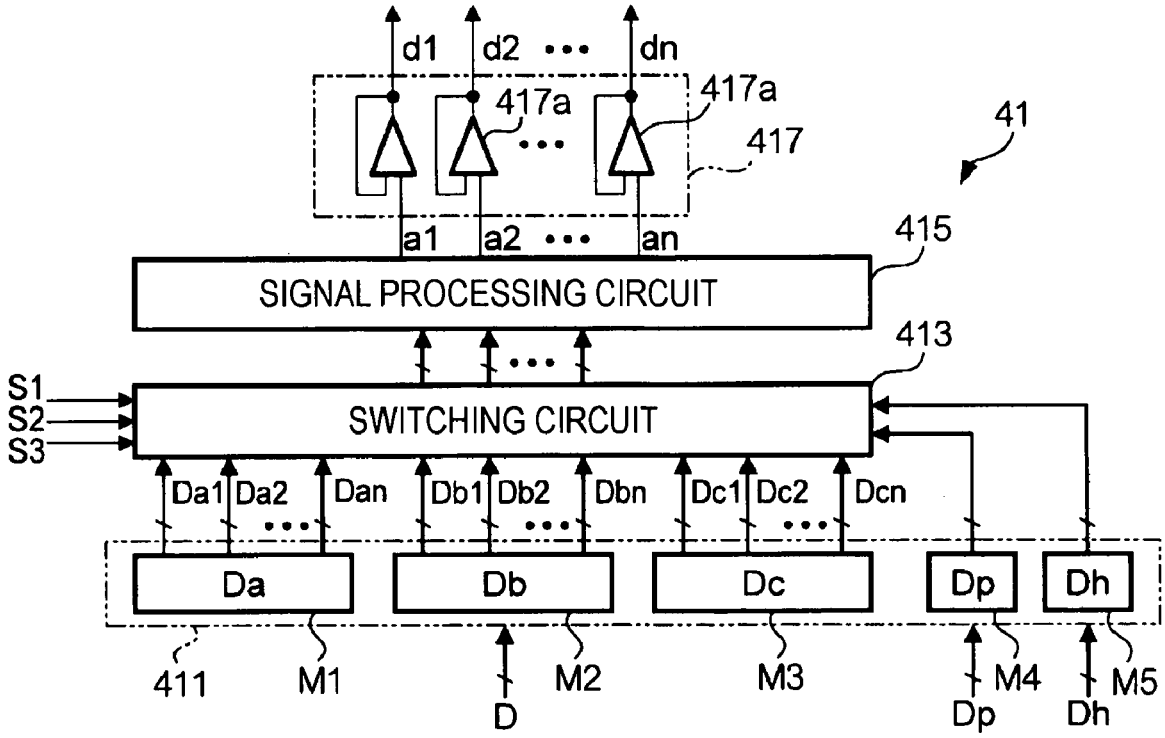
FIG. 3 is a block diagram showing a configuration of a voltage output circuit.

Next, FIG. 3 is a block diagram showing the specified configuration of the voltage output circuit 41 in the present embodiment. As shown in FIG. 3, the voltage output circuit 41 has a memory 411, a switching circuit 413, a signal processing circuit 415, and an output circuit 417. Among these, the memory 411 is a unit for rewritably storing data (for example, a RAM (Random Access Memory)), and sequentially stores gray-scale data D supplied from the outside in series. In the memory 411, memory areas M1 to M3 are ensured. Among these, the memory area M1 stores gray-scale data Da (Da1 to Dan) of the pixels P connected to the data lines 13 of the first column of the groups G1 to Gn. Similarly, the memory area M2 is an area in which gray-scale data Db (Db1 to Dbn) of the pixels P of the second column of each group Gj is stored. Further, the memory area M3 is an area in which gray-scale data Dc (Dc1 to Dcn) of the pixels P of the third column of each group Gj is stored.

In the memory 411, in addition to the memory areas, a memory area M4 into which digital data (hereinafter, referred to as 'precharge voltage data') Dp for defining the value of the precharge voltage Vp is written, and a memory area M5 into which digital data (hereinafter, referred to as 'compensation voltage data') Dh for defining the value of the compensation voltage Vh is written are ensured. Precharge voltage data Dp stored in the memory area M4 and compensation voltage data Dh stored in the memory area M5 are suitably changed according to inputs from the outside. For example, when a user inputs the value of the precharge voltage Vp or the compensation voltage Vh by operating a handler (not shown), data stored in the memory area M4 or M5 of the memory 411 is updated to precharge voltage data Dp or compensation voltage data Dh, which represents a new input voltage.

The switching circuit 413 is a circuit that reads out and outputs any one of gray-scale data Da to Dc, precharge voltage data Dp, and compensation voltage Dh stored in the memory 411 with a timing according to the sampling signals S1 to S3. Specifically, first, the switching circuit 413 reads out and outputs precharge voltage data Dp from the memory area M4 in the precharge period Tp. Next, the switching circuit 413 sequentially reads out and outputs gray-scale data Da to Dc from the memory 411 in the respective data output periods Td. That is, the switching circuit 413 reads out and outputs gray-scale data Da1 to Dan of the respective pixels P of the first column in the groups G1 to Gn from the memory area M1 in the data output period Td1, reads out and outputs gray-scale data Db1 to Dbn of the respective pixels P of the second column from the memory area M2 in the data output period Td2, and reads out and outputs gray-scale data Dc1 to Dcn of the respective pixels P of the third column from the memory area M3 in the data output period Td3. Then, the switching circuit 413 reads out and outputs compensation voltage data Dh from the memory area M5 in the voltage compensation period Th.

The signal processing circuit 415 is a unit for outputting the gray-scale signals d1 to do according to data output from the switching circuit 413, and has a D/A converter and a polarity inversion circuit. Of these, the D/A converter is a circuit for converting digital data to be supplied from the switching circuit 413 into an analog signal and outputting n channels. Specifically, when precharge voltage data Dp is input in the precharge period Tp, the D/A converter converts precharge voltage data Dp into an analog signal, divides the analog signal into n channels corresponding to the total number of groups Gj, and outputs the n channels. Further, when gray-scale data D (one of Da to Dc) for the n pixels P is input in each data output period Td, the D/A converter converts gray-scale data D into an analog signal, divides the analog signal into n channels, and outputs the n channels. In addition, when compensation voltage data Dh is input in the voltage compensation period Th, the D/A converter converts compensation voltage data Dh into an analog signal, divided the analog signal into n channels, and outputs the n channels.

On the other hand, the polarity inversion circuit is a circuit that outputs the signals al to an of the n channels output from the D/A converter while inverting their polarities. The polarity inversion is a processing for alternately switching the voltage level of each of the signals al to an from one of positive and negative polarities to the other polarity on the basis of a prescribed voltage Vc (for example, a voltage to be applied to the counter electrode 733). The signals to be subjected to the polarity inversion of the signals al to an of the n channels are suitably selected according to modes for applying a voltage to each pixel P, that is, [1] a mode in which the polarity is inverted for each vertical scanning period (so-called frame inversion), [2] a mode in which the polarity is inverted for the pixels P connected to the common scanning line 12 (so-called row inversion), [3] a mode in which the polarity is inverted for the pixels P connected to the common data line 13 (so-called column inversion), and [4] a mode in which the polarity is inverted for each pixel P neighboring in the X and Y directions (so-called pixel P inversion). In the present embodiment, it is assumed that, like the above-described mode [2], a mode in which the polarities of the signals al to an are inverted for each selection period is used. Moreover, here, the configuration in which the polarities of the signals output from the D/A converter are inverted is exemplified, but, in contrast, a configuration may be used in which data to be supplied from the switching circuit 413 is converted into data representing the voltage value after the polarity inversion, and converted data is subjected to the D/A conversion, such that the signals al to an of the n channels are output. Moreover, here, it is assumed that a constant potential is applied to the counter electrode 733, but, a configuration may be used in which the voltage to be applied to the counter electrode 733 is switched from one of two kinds of voltage levels to the other with a timing that the polarity of each of the signals al to an is inverted.

The output circuit 417 shown in FIG. 3 has n output buffers 417*a* corresponding to the total number of groups Gj. The output buffers 417*a* are voltage follower-type operational amplifiers, and output the signals al to an output from the signal processing circuit 415 to the sampling circuit 15 as the gray-scale signals d1 to dn.

Next, the waveform of the data signal Xj (Xaj, Xbj, and Xcj) applied to each data line 13 in the present embodiment will be described with reference to FIG. 4. Moreover, here, the descriptions will be given, in particular, focusing on the group G1 and the group G2. Further, as shown in FIG. 5, it is assumed that the pixels P of the first column and the second column of the group G1 and all the pixels P of the group G2 are caused to display halftone, and the pixels P of the third column of the group G1 are caused to display black (that is, one black vertical line is displayed with a gray background).

Figure 11:
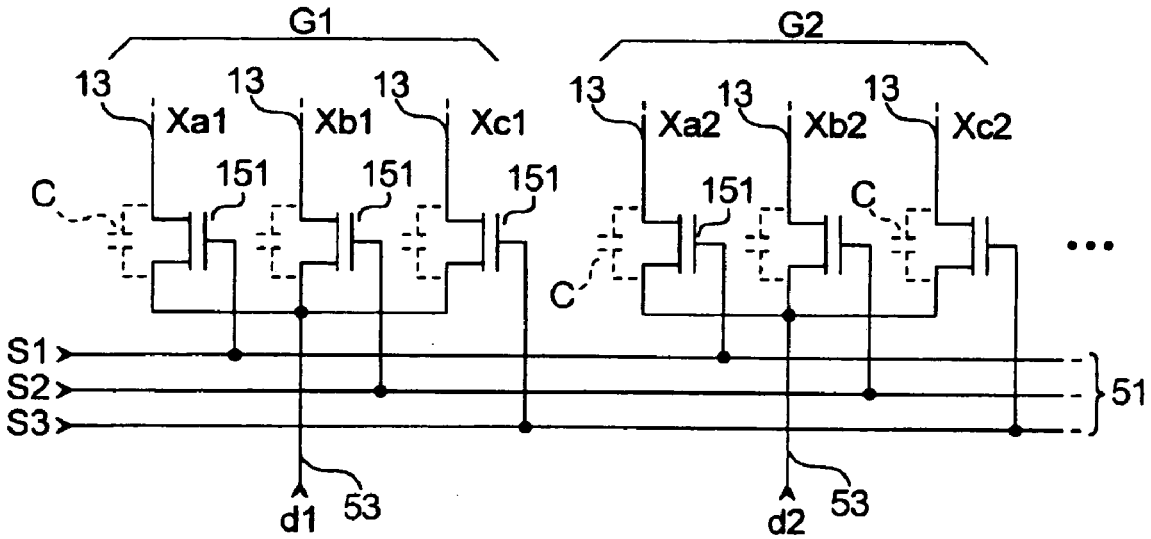
FIG. 11 is a circuit diagram showing a configuration of a part, which drives data lines, in an electro-optical device according to the related art.
Figure 13:
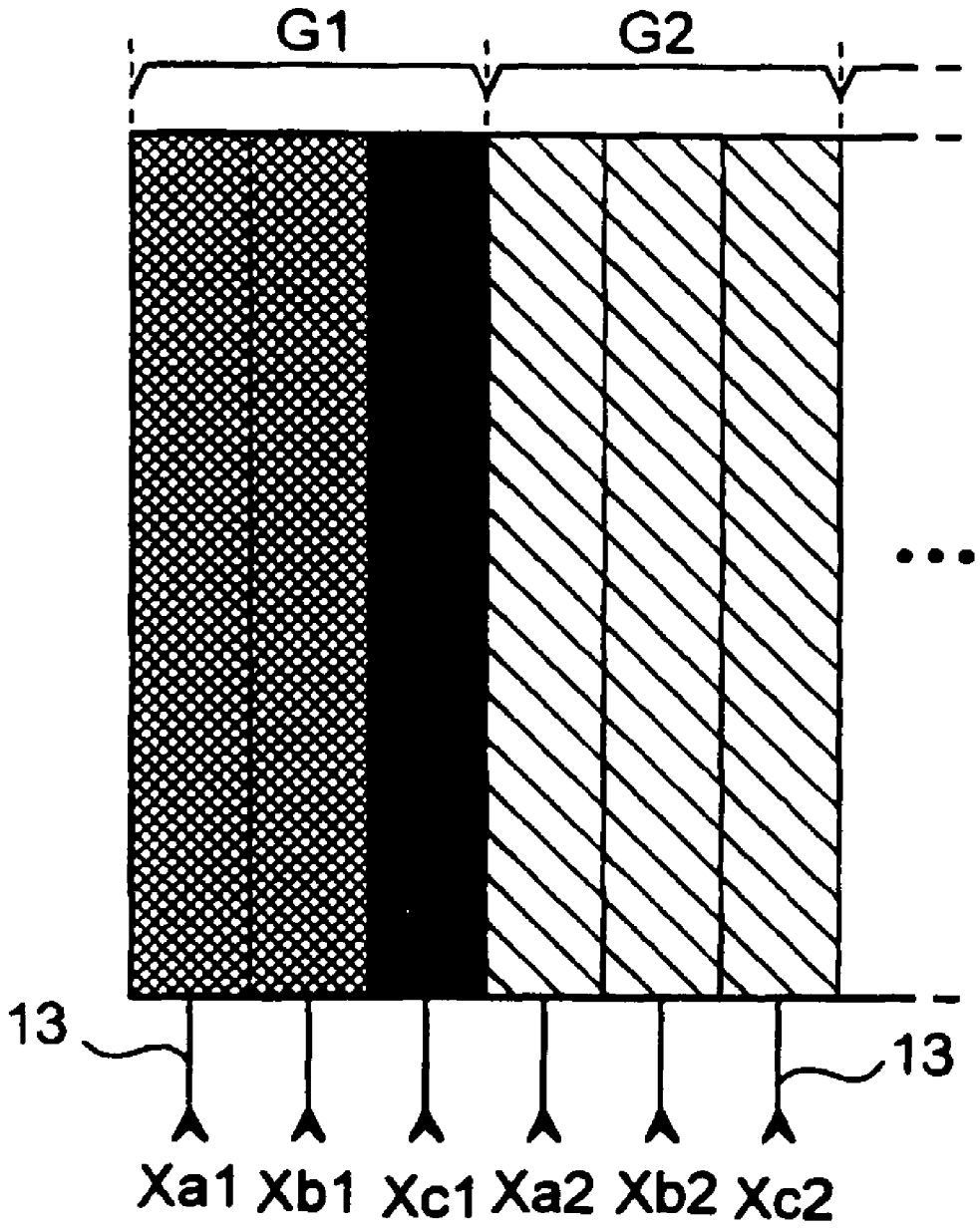
FIG. 13 is a diagram showing a state in which display irregularity occurs in the electro-optical device according to the related art.

As shown in FIG. 4, the voltage of the data signal Xc1 to be supplied to the data line 13 of the third column of the group G1 is changed to the precharge voltage Vp at the start point of the precharge period Tp, maintains the precharge voltage Vp until the start point of the third data output period Td3 comes, and, if the sampling signal S3 is changed to the active level at the start point of the data output period Td3 and the switching element is turned on, is changed to the voltage Vb corresponding to black. On the other hand, the voltage of the data signal Xa1 to be supplied to the data line 13 of the first column of the group G1 is changed to the precharge voltage Vp at the start point of the precharge period Tp, maintains the precharge voltage Vp until the start point of the first data output period Td1 comes, and, if the sampling signal S1 is changed to the active level at the start point of the data output period Td1, is changed to the voltage Vg corresponding to halftone. Here, preferably, the voltage of the data signal Xa1 is originally maintained as the voltage Vg until the start point of the data output period Td1 comes. However, as shown in FIG. 11, each data line 13 is capacitively coupled to the image signal line 53 via the switching element 151. Accordingly, if the gray-scale signal d1 to be supplied to the image signal line 53 is increased from the voltage Vg up to the voltage Vb at the start point of the data output period Td3, the data signal Xa1 to be applied to the data line 13 at that time is increased from the voltage Vg by ΔV1 according to the change of the gray-scale signal d1. At this time, the switching elements 71 of the i-th row are turned on, and thus the voltage of the pixel capacitor 73 of each of the pixels P connected to the switching elements 71 is increased according to the change amount ΔV1 of the voltage of the data line 13. As a result, if the voltage of the data signal Xa1 is maintained as it is, as shown in FIG. 13, the gray-scale level of each of the pixels P of the first column (and the second column) of the group G1 becomes darker than an expected gray-scale level (that is, the gray-scale level corresponding to the voltage Vg).

Figure 12:
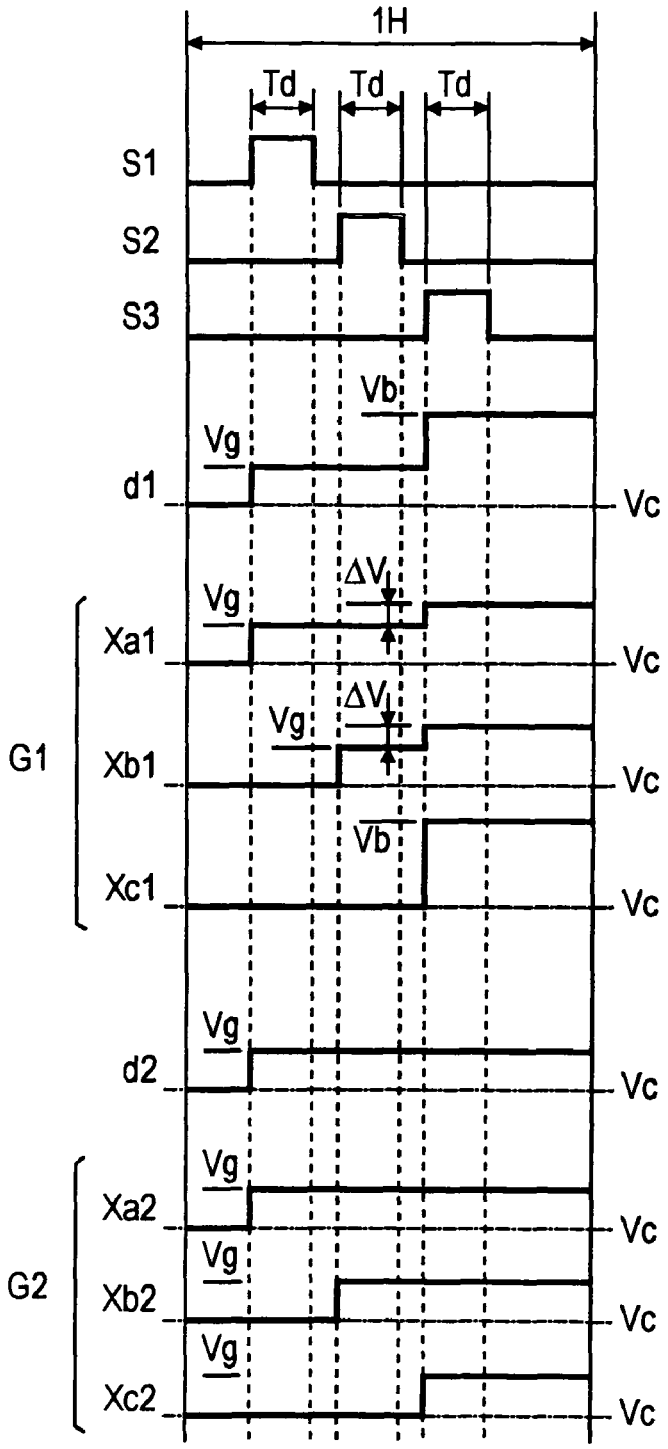
FIG. 12 is a timing chart illustrating an operation of the electro-optical device according to the related art.

In consideration of this situation, in the present embodiment, if the start point of the voltage compensation period Th comes, the voltage output circuit 41 changes the voltage of the gray-scale signal d1 from the voltage Vb to the compensation voltage Vh in the data output period Td3. As described above, the image signal line 53 supplied with the gray-scale signal d1 and the data line 13 supplied with the data signal Xa1 are capacitively coupled to each other via the switching element 151, and thus, if the gray-scale signal d1 is changed from the voltage Vb to the compensation voltage Vh, the data signal Xa1 is decreased from the voltage (Vg+ΔV1) at that time by ΔVh. At this time, since the switching elements 71 of the i-th row are turned on, the voltage of the pixel capacitor 73 of each of the pixels P connected to the switching elements 71 is decreased according to the change amount ΔVh of the voltage of the data line 13. That is, in the present embodiment, the voltage of the actual data signal Xaj can be approximated to the original voltage Vg according to halftone, as compared with the related art in which the voltage of the data signal Xaj, which is increased by ΔV1 according to the change of the gray-scale signal d1, is maintained as it is (see FIG. 12). Moreover, here, even when the data signal Xa1 is focused on, the voltage of the data signal Xb1 to be supplied to the data line 13 of the second column belonging to the group G1 is also changed by ΔV1 and ΔVh, like the data signal Xa1. That is, the voltage of the data signal Xb1 is increased from the voltage Vg at that time by ΔV1 at the start point of the data output period Td3, but is decreased by ΔVh as the voltage of the gray-scale signal dj is changed to Vh at the start point of the voltage compensation period Th. As such, in the present embodiment, the change in voltage of the data signals Xj (Xaj, Xbj, and Xcj) to the respective data lines 13 belonging to one group Gj is made uniform. Therefore, the gray-scale level of each of the pixels P of the first column belonging to the group Gj is suppressed from being darker than the original gray-scale level, such that display irregularity is prevented. That is, as shown in FIG. 5, the gray-scale level of each of the pixels P of the first column and the second column belonging to the group G1 has halftone substantially equal to the gray-scale level of each of the pixels P of the group G2.

Moreover, as shown in FIG. 4, the gray-scale signal d2 corresponding to the group G2 becomes Vg corresponding to halftone over all the data output periods Td1 to Td3, and, when the voltage compensation period Th comes, is changed to the voltage Vh. Therefore, the data signals Xa2, Xb2, and Xc2 to be supplied to the respective data lines 13 are changed by the ΔV2 at the start point of the voltage compensation period Th. Further, focusing on the group G1 and the group G2, the voltage 'Vg+ΔV1−ΔVh' of the data signal Xa1 is substantially equal to the voltage 'Vg+ΔV2' of the data signal Xa2. As such, since the data signals Xj corresponding to the pixels P in each group Gj, which display the same gray-scale level, are changed up to the substantially same voltage, display irregularity due to the difference in application voltage to the respective data lines 13 does not occur.

In the present embodiment, at the start point of the voltage compensation period Th of any selection period (1H), the voltage of the gray-scale signal dj is changed to the compensation voltage Vh, and the voltage Vh is maintained after the end point of the selection period has lapsed. On the other hand, in view of suppressing display irregularity by decreasing, by Vh, the data signal Xa1 or the data signal Xb1, which is increased by ΔV1, a configuration may be considered in which, with a timing of the end point of the selection period, the next precharge period Tp is provided, such that the voltage of the gray-scale signal d1 is changed from the voltage Vh to the voltage Vp. However, the timing at which the scanning line Yi falls may be made later than the original timing due to various conditions. When the scanning signal Yi delayed in such a manner is maintained at the active level, the gray-scale signal d1 may be changed from the compensation voltage Vh to the precharge voltage Vp. In this case, however, since each switching element 71 of the i-th row is turned on at that time, the voltage stored in the pixel capacitor 73 in advance may be changed again according to the changed in voltage. In contrast, in the present embodiment, at a stage where the original selection period lapses and the scanning signal Yi completely becomes the inactive level (that is, a stage where the switching element 71 is completely turned off), the voltage of the gray-scale signal d1 is changed from the compensation voltage Vh to the precharge voltage Vp, and thus the above-described problem is solved.

Second Embodiment

Next, a second embodiment of the invention will be described. Moreover, of an electro-optical device according to the present embodiment, the same parts as those in the first embodiment are represented by the same reference numerals and the descriptions thereof will be omitted.

Figure 6:
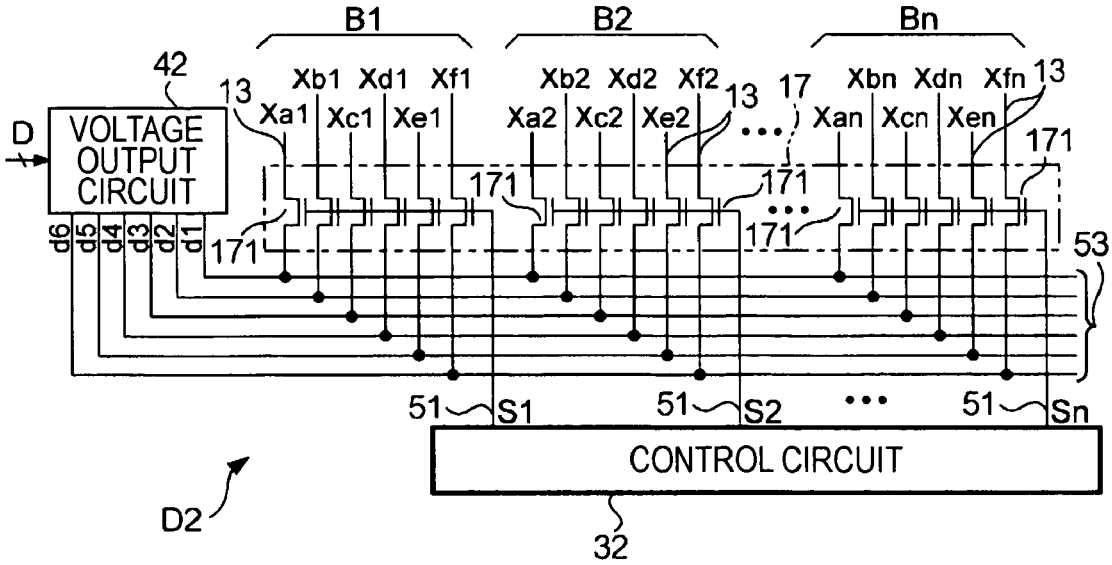
FIG. 6 is a block diagram partially showing a configuration of an electro-optical device according to a second embodiment of the invention.

FIG. 6 is a diagram showing the configuration of a part in respects to driving the data lines 13 in an electro-optical device D2 according to the present embodiment. Moreover, the scanning line driving circuit 20 or the pixel P has the same configuration as that of the first embodiment. As shown in FIG. 6, the electro-optical device D2 has a voltage output circuit 42, a control circuit 32, and a sampling circuit 17. Among these, the voltage output circuit 42 has a D/A converter that converts gray-scale data D to be supplied from the outside in series into an analog signal and outputs the analog signal, and a S/P conversion circuit that distributes the signal output from the D/A converter into a plurality of channels (in the present embodiment, six channels) and simultaneously enhances the signal of each channel six times in the time axis direction to output the gray-scale signals d1 to d6 (serial-to-parallel conversion). The gray-scale signals d1 to d6 output from the S/P conversion circuit are subjected to a proper polarity inversion or amplification and are output to the image signal lines 53, like the first embodiment. Further, though the details are described below, like the first embodiment, the voltage output circuit 42 changes the voltage of each of the gray-scale signals d1 to d6 to the compensation voltage Vh in the voltage compensation period Th after the last data output period Td of each selection period has lapsed.

As shown in FIG. 6, the electro-optical device D2 of the present embodiment has 6n data lines 13. The data lines 13 are divided into n blocks B1 to Bn, each block having six adjacent data lines 13. The sampling circuit 17 has 6n switching elements 171 corresponding to different data lines 13. The switching elements 171 are switches for sampling the gray-scale signals d1 to d6, which are supplied to the image signal lines 53, to the data lines 13. For example, each switching element 171 is a TFT element formed on the surface of the element substrate using the common process to the switching element 71 of the pixel P with the same material. A drain electrode of each switching element 171 is connected to the corresponding data line 13. On the other hand, source electrodes of the six switching elements 171 belonging to each of the blocks B1 to Bn are correspondingly connected to six image signal lines 53. That is, in the respective blocks B1 to Bn, the source electrodes of the switching elements 171 of the first columns are commonly connected to the image signal line 53, to which the gray-scale signal d1 is supplied, and the source electrodes of the switching elements 171 of the second columns are commonly connected to the image signal line 53, to which the gray-scale signal d2 is supplied. In the present embodiment, n data lines 13 connected to the common image signal line 53 via the switching elements 171 are understood as the 'group' in the first embodiment. That is, though the configuration is exemplified in which the plurality of adjacent data lines 13 are divided as one group Gj in the first embodiment, the data lines 13 of the same columns belonging to the blocks B1 to Bn are divided as one group in the present embodiment. As such, the 'group' in the invention means the collection of the data lines 13 connected to the common image signal line 53.

Figure 7:
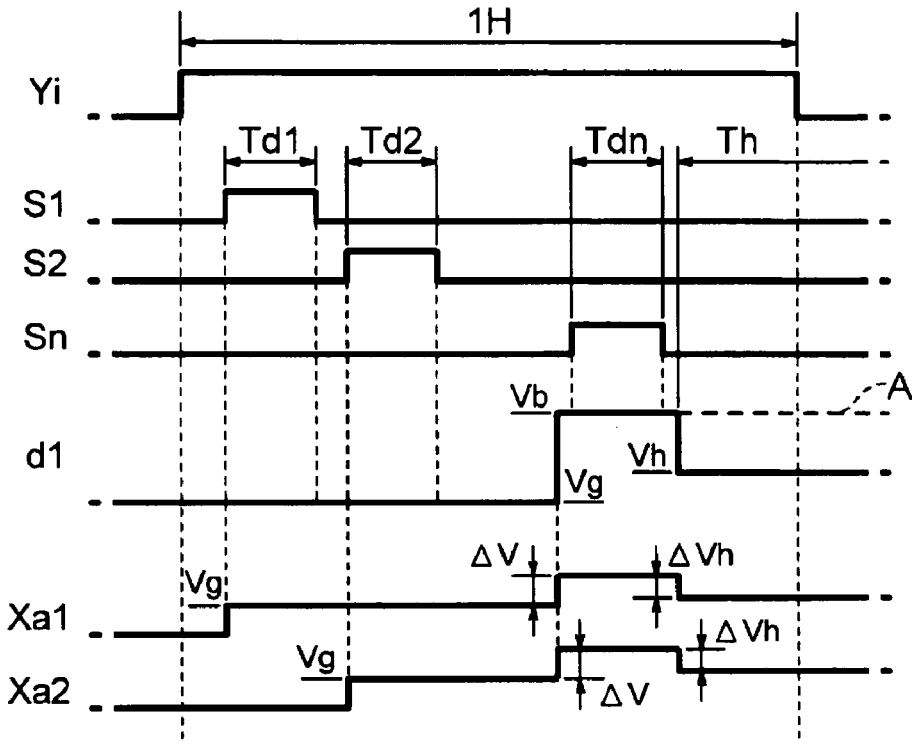
FIG. 7 is a timing chart illustrating an operation of the electro-optical device according to the second embodiment of the invention.

On the other hand, the control circuit 32 is a shift register of n bits corresponding to the total number of blocks B1 to Bn, and outputs the sampling signals S1 to Sn to the sampling signal lines 51. As shown in FIG. 7, the sampling signals S1 to Sn are signals which sequentially become the active level in the respective data output periods Td (Td1, Td2, . . . , Tdn) in the selection period, in which the scanning signal Yi becomes the active level and the i-th scanning line 12 is selected. Gate electrodes of the six switching elements 171 connected to the data lines 13 of one block Bj are commonly connected to a terminal of the control circuit 32, from which the sampling signal Sj is output. Therefore, if the sampling signal Sj is changed to the active level in the j-th data output period Tdj of the selection period, the six switching elements 171 belonging to the block Bj are simultaneously turned on, and the gray-scale signals d1 to d6, which are supplied to the image signal lines 53 at this time, are sampled to the six data lines 13 of the corresponding block Bj as the data signals Xj (Xaj, Xbj, . . . , Xfj).

Next, the operation of the present embodiment will be described. Moreover, here, it is assumed that the pixels P of the first column belonging to the block Bn are caused to display black and all other pixels P are caused to display halftone (gray) (see FIG. 8). FIG. 7 is a timing chart showing waveforms of the respective signals in that case. As shown in FIG. 7, the gray-scale signal d1 to be output from the voltage output circuit 42 is maintained as the voltage Vg corresponding to halftone just before the start point of the data output period Tdn, in which the sampling signal Sn becomes the active level. The voltage Vg is sampled to the data lines 13 of the first columns belonging to the respective blocks B1 to Bn as the data signals Xa1 to Xan−1 by means of the switching elements 171, which are turned on according to the sampling signals S1 to Sn−1.

On the other hand, just before the start point of the data output period Tdn, the voltage of the gray-scale signal d1 becomes the voltage Vb corresponding to black. Here, as described in the first embodiment, the image signal line 53 and the data lines 13 are capacitively coupled to each other via the switching elements 171, and thus the potential of the data line 13 of the first column belonging to each block Bj is increased by ΔV according to the change of the gray-scale signal d1. For example, as shown in FIG. 7, the voltage of the data line 13 of the first column belonging to the block B1 (the voltage of the data signal Xa1) is maintained as the voltage Vg from the start point of the data output period Td1, and is increased by ΔV with a timing at which the gray-scale signal d1 is changed from the voltage Vg to the voltage Vb. At this time, the switching element 71 of the i-th row is turned on, and thus the voltage of the pixel capacitor 73 connected thereto is changed according to the change amount ΔV of the voltage of the data line 13. On the other hand, the voltage output circuit 42 changes the gray-scale signal d1 from the voltage Vb to the compensation voltage Vh with a timing before the end point of the selection period after the data output period Tdn has lapsed. According to this change, as shown in FIG. 7, the voltage of each of the data lines 13 of the first columns of the respective blocks B1 to Bn−1 is decreased from the voltage (Vg+ΔV) by ΔVh. In addition, the voltage of the gray-scale signal d1 is maintained as the compensation voltage Vh over the voltage compensation period Th until the selection period lapses.

Figure 8:
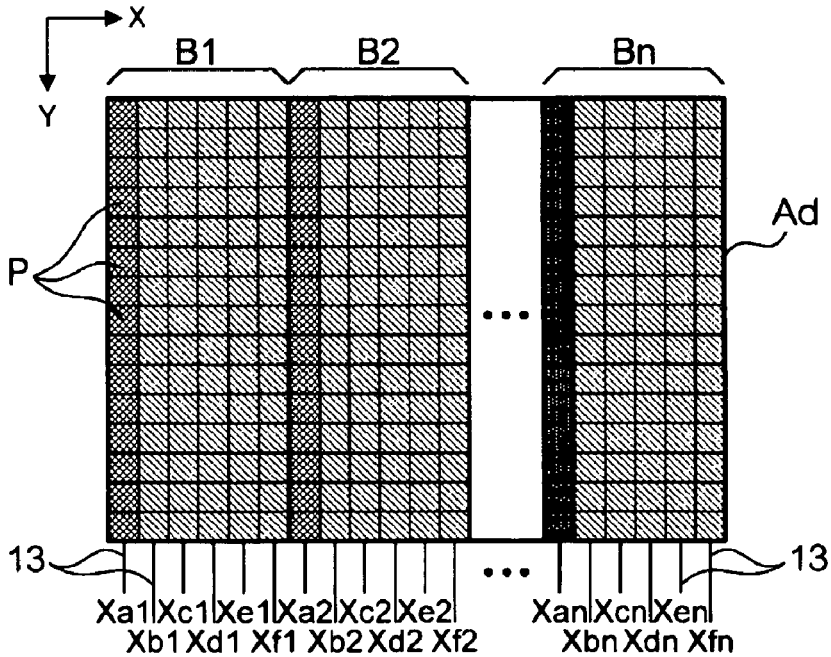
FIG. 8 is a diagram illustrating effects of the second embodiment of the invention.

Here, as a comparative example of the present embodiment, a case in which the voltage of the gray-scale signal d1 is maintained as the voltage Vb in the data output period Tdn even after the last data output period Tdn in the selection period has lapsed is described. In this case, if the voltage of each of the data lines 13 of the first column of each block Bj is increased by ΔV with a timing at which the gray-scale signal d1 is changed from the voltage Vg to the voltage Vb, the end point of the selection period comes in a state in which the voltage (Vg+ΔV) is maintained as it is, and thus the voltage stored in the pixel capacitor 73 of each pixel P is maintained higher than the original voltage Vg by ΔV. For this reason, as shown in FIG. 8, each of the pixels P of the first columns belonging to the blocks B1 to Bn−1 becomes the gray-scale level closer to black than original halftone (halftone displayed by the pixels P of other columns), such that vertical line-shaped display irregularity is perceived by a user. In contrast, in the present embodiment, after the last data output period Tdn of each selection period has lapsed, the voltage of the gray-scale signal d1 is changed to the compensation voltage Vh, and thus, as shown in FIG. 7, the voltage of each of the data lines 13 of the first column of each block Bj can be made closer to the voltage Vg according to halftone. Therefore, as compared with the related art shown in FIG. 8, the gray-scale level of each of the pixels P of the first column belonging to each block Bj is suppressed from being darker than the original gray-scale level, such that display irregularity is prevented. Moreover, here, the description has been given, in particular, focusing on the gray-scale signal d1, but, other gray-scale signals d2 to d6 also become the compensation voltage Vh after the last data output period Tdn of each selection period has lapsed. Therefore, even when any gray-scale signal is changed in the selection period, display irregularity due to this change is effectively suppressed.

Modifications

Various modifications are made for the respective embodiments. The specified modifications are exemplified as follows. Moreover, the following modifications may be properly combined.

Though the data lines 13 are divided into the groups, each group having three data lines 13, in the first embodiment, and the data lines 13 are divided into the blocks B1 to Bn, each block having six data lines 13, in the second embodiment, the number of data lines 13 belonging to each group or each block is not limited thereto.

Figure 9:
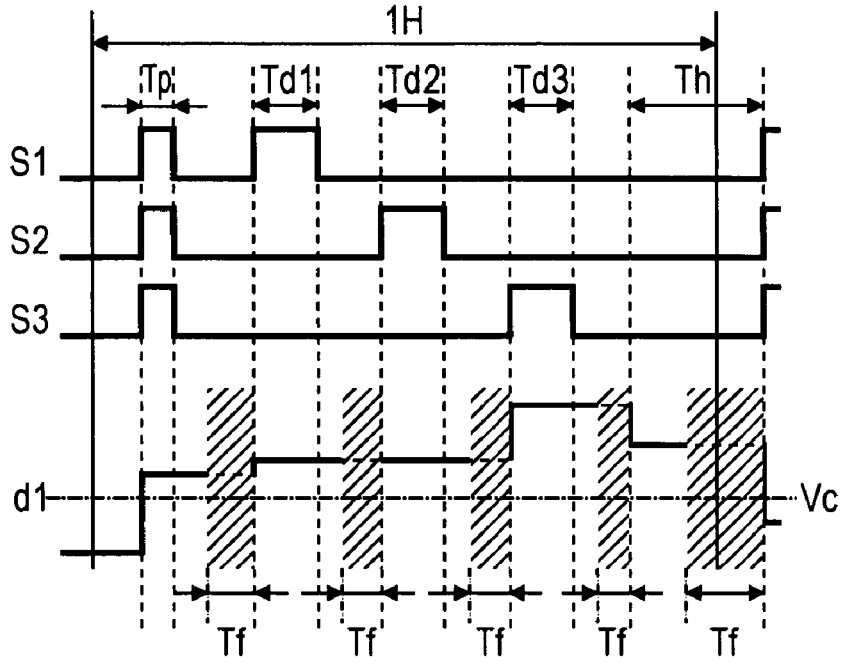
FIG. 9 is a timing chart illustrating an operation of an electro-optical device according to a modification.

In addition to the configurations of the respective embodiments, a configuration in which the voltage output circuit 41 or 42 makes its output into a high impedance state may be used. FIG. 9 is a timing chart showing the operation when the present modification is applied to the first embodiment. In FIG. 9, a period Tf in which the output terminal of each of the gray-scale signals d1 to dn in the voltage output circuit 41 is made into the high impedance state is indicated by a hatched region. As shown in FIG. 9, in the present modification, in an interval between the precharge period Tp and the data output periods Td1 to Td3 (that is, with a timing just before each data output period Td), the output terminal of each of the gray-scale signals d1 to dn in the voltage output circuit 41 is made into the high impedance state. Further, the output terminal of the voltage output circuit 41 is maintained in the high impedance state even in the period Tf until the precharge period Tp of the next selection period comes after the start point of the voltage compensation period Vh comes and the voltage of the gray-scale signal d1 is changed to the compensation voltage Vh. According to this configuration, the voltage Vp in the precharge period Tp, the voltage Vg or Vb in each data output period Td, and the voltage Vh in the voltage compensation period Th are separately output, and thus an expected voltage can be reliably output in each period with high precision. Moreover, here, though the modification on the first embodiment has been described, the same modification can be performed on the second embodiment.

In the respective embodiments, the configuration has been exemplified in which the compensation voltage is maintained until each selection period lapses. Alternatively, a configuration may be used in which the compensation voltage Vh is maintained only up to the timing of the end point of each selection period (that is, the voltage of the gray-scale signal d1 is changed from the compensation voltage Vh to the precharge voltage Vp with that timing), as long as the deviation in rising timing of the scanning signal Yi is not problematic.

In the respective embodiments, the configuration has been exemplified in which each data line 13 is charged and discharged by means of the precharge voltage Vp just after the start point of each selection period. According to this configuration, the time required for charging and discharging the data line 13 in each data output period Td can be reduced, and thus the pixel P can be driven at high speed. However, as long as the time required for charging and discharging the data line 13 is not problematic, the configuration in which the precharge voltage Vp is applied to the respective data lines 13 may be omitted. Further, in the respective embodiments, the configuration has been exemplified in which the gray-scale signal dj is precharged in the respective data lines 13 as the precharge voltage Vp, but the configuration for precharging the data lines 13 is not limited thereto. For example, a configuration may be used in which, prior to the data output period Td, the data lines 13 are charged and discharged by electrically connecting the respective data lines 13 to wiring lines, to which the precharge voltage Vp is applied.

In the respective embodiments, the electro-optical devices D1 and D2, which use liquid crystal as the electro-optical material, have been exemplified, but the invention can be applied to a device, which uses an electro-optical material other than liquid crystal. For example, like the embodiments, the invention can be applied to various electro-optical devices, such as a display device in which an OLED (Organic Light Emitting Diode) element, such as an organic electroluminescent element or a light-emitting polymer, is used as the electro-optical material, an electrophoretic display device in which a microcapsule containing colored liquid and white particles dispersed in the colored liquid is used as the electro-optical material, a twist ball display that uses twist balls, in which different colored balls are coated to regions having different polarities, as an electro-optical material, a toner display in which a black toner is used as the electro-optical material, a plasma display panel in which high-pressure gas, such as helium or neon, is used as the electro-optical material, and the like.

Electronic Apparatus

Figure 10:
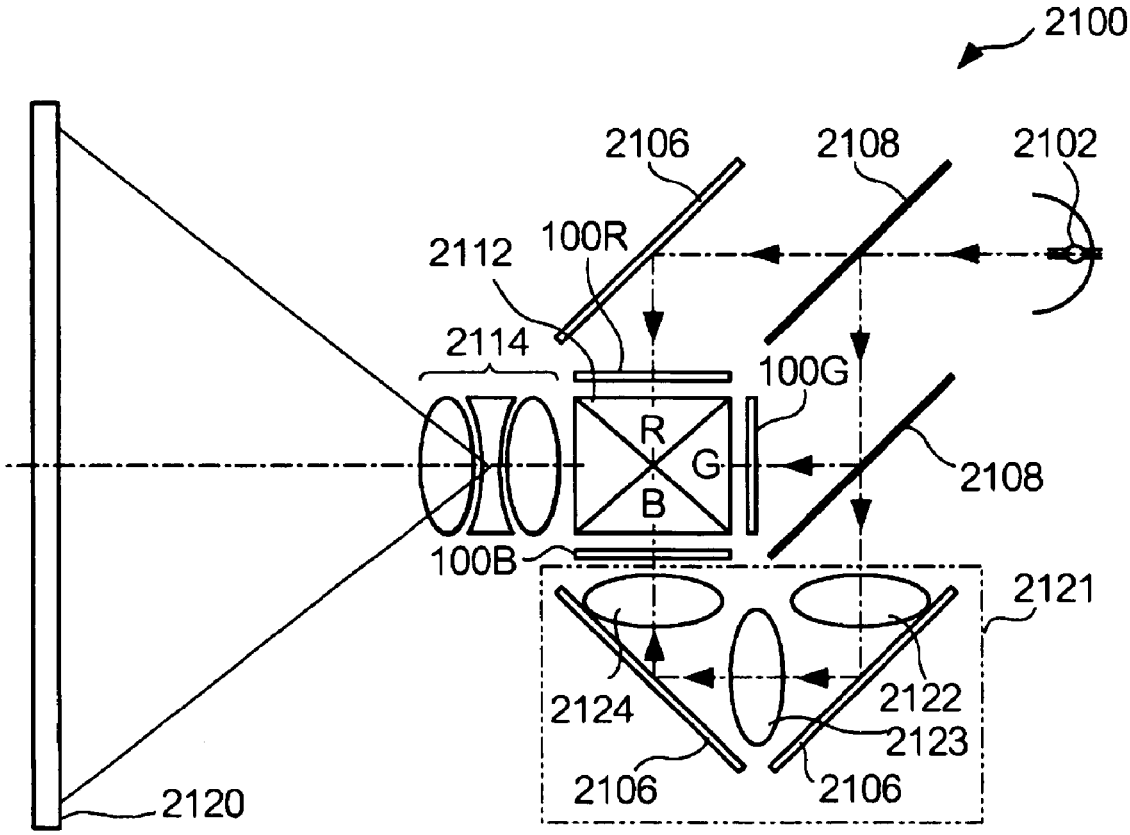
FIG. 10 is a diagram showing a configuration of a projection-type display device, which is an example of an electronic apparatus according to the invention.

Next, a projection-type display device (projector), which is an example of an electronic apparatus according to the invention and uses an electro-optical device D1 or D2 according to the embodiment as a light value, will be described. FIG. 10 is a plan view showing the configuration of the projection-type display device. As shown in FIG. 10, in the projection-type display device 2100, a lamp unit 2102 having a white light source, such as a halogen lamp or the like, is provided. Projection light emitted from the lamp unit 2102 is separated into light components of three primary colors of R (red), G (green), and B (blue) by three mirrors 2106 and two dichroic mirrors 2108 disposed in the projection-type display device. The separated light components are incident on light valves 100R, 100G, and 100B corresponding to the respective primary colors. Moreover, the light component of B is guided through a relay lens system 2121, which has an incident lens 2122, a relay lens 2123, and an emitting lens 2124, in order to prevent optical loss due to a long optical path.

Here, the configurations of the light valves 100R, 100G, and 100B are the same as that of the electro-optical device D1 or D2 of the embodiment, and are driven by gray-scale data D corresponding to the respective colors of R, G, and B supplied from a processing circuit (not shown). Then, the light components modulated by the light valves 100R, 100G, and 100B are incident on a dichroic prism 2112 from three directions. Then, in the dichroic prism 2112, the light components of R and B are refracted by 90 degrees and the light component of G passes through straight. Therefore, the images of the respective colors are combined and then projected as a color image on a screen 2120 through a projection lens 2114.

Moreover, since the light components corresponding to the respective primary colors of R, G, and B are incident on the light valves 100R, 100G, and 100B by means of the dichroic mirrors 2108, color filters does not need to be provided. Further, the transmitted images of the light valves 100R and 100B are reflected by the dichroic prism 2112 and then projected, while the transmitted image of the light value 100G is projected as it is. Therefore, the horizontal scan direction by the light valves 100R and 100B is opposite to the horizontal scan direction by the light valve 100G, such that the images of which the right and left sides are reversed are displayed.

Further, as an electronic apparatus in which the electro-optical device according to the invention can be used, in addition to the projection-type display device shown in FIG. 10, a cellular phone, a portable personal computer, a digital video camera, a liquid crystal television, a viewfinder-type (or monitor-direct-view-type) video recorder, a car navigation device, a pager, an electronic organizer, an electronic calculator, a word processor, a workstation, a video phone, a POS (Point On Sale) terminal, an apparatus having a touch panel, or the like can be exemplified.

What is claimed is:

1. A circuit for driving an electro-optical device, the electro-optical device having a plurality of scanning lines, a plurality of data lines divided into groups, each group having a predetermined number of data lines, and a plurality of pixels disposed to correspond to intersections of the plurality of scanning lines and the plurality of data lines, the circuit for driving an electro-optical device comprising:

a scanning line driving circuit that selects each of the plurality of scanning lines for each selection period, the selection period including a plurality of data output periods;

a plurality of image signal lines;

a plurality of switching elements that switch between conductive states and non-conductive states of the data lines belonging to each group and the image signal line corresponding to each group;

a control circuit that sequentially switches the switching elements corresponding to each group to the conductive states for each data output period in the selection period; and a voltage output circuit that (1) simultaneously applies, in a precharge period prior to the plurality of data output periods of the selection period, a predetermined precharge voltage to each image signal line, (2) applies a voltage according to a gray-scale level of each pixel to each image signal line in each data output period of the selection period, (3) applies a predetermined voltage to each image signal line in a period after the last data output period of the selection period has lapsed, and (4) applies the predetermined precharge voltage to each image signal line simultaneously after one selection period has lapsed, wherein the predetermined voltage is selected in advance regardless of the gray-scale level of each pixel, wherein the predetermined precharge voltage is different from the predetermined voltage, wherein the switching elements are in non-conductive states during the period after the last data output period of the selection period has lapsed such that the predetermined voltage is applied only to the image signal lines, and wherein each image signal line supplies the gray-scale voltage to a corresponding group.

2. The circuit for driving an electro-optical device according to claim 1, wherein the predetermined voltage is a central voltage of a voltage for causing each pixel to display the highest gray-scale level and a voltage for causing each pixel to display the lowest gray-scale level.

3. The circuit for driving an electro-optical device according to claim 1, wherein the voltage output circuit continues to apply the predetermined voltage to each image signal line even after each selection period has lapsed.

4. The circuit for driving an electro-optical device according to claim 1, wherein the voltage output circuit makes its output into a high impedance state in a period just before each data output period and in a period after the predetermined voltage is applied to the image signal line.

5. The circuit for driving an electro-optical device according to claim 1, wherein the plurality of data lines are divided into groups, each group having a plurality of adjacent data lines.

6. The circuit for driving an electro-optical device according to claim 1, wherein the plurality of data lines are divided into blocks, each block having a plurality of adjacent data lines and one group having the data lines belonging to a plurality of blocks.

7. An electro-optical device comprising:

a plurality of scanning lines;

a plurality of data lines that are divided into groups, each group having a predetermined number of data lines;

a plurality of pixels that are disposed to correspond to intersections of the plurality of scanning lines and the plurality of data lines;

a scanning line driving circuit that selects each of the plurality of scanning lines for each selection period, the selection period including a plurality of data output periods;

a plurality of image signal lines;

a plurality of switching elements that switch between conductive states and non-conductive states of the data lines belonging to each group and the image signal line corresponding to each group;

a control circuit that sequentially switches the switching elements corresponding to each group to the conductive states for each data output period of the selection period; and a voltage output circuit that (1) simultaneously applies, in a precharge period prior to the plurality of data output periods of the selection period, a predetermined precharge voltage to each image signal line, (2) applies a voltage according to a gray-scale level of each pixel to each image signal line in each data output period of the selection period, (3) applies a predetermined voltage to each image signal line in a period after the last data output period of the selection period has lapsed, and (4) applies the predetermined precharge voltage to each image signal line simultaneously after one selection period has lapsed, wherein the predetermined voltage is selected in advance regardless of the gray-scale level of each pixel, wherein the predetermined precharge voltage is different from the predetermined voltage, wherein the switching elements are in non-conductive states during the period after the last data output period of the selection period has lapsed such that the predetermined voltage is applied only to the image signal lines, and wherein each image signal line supplies the gray-scale voltage to a corresponding group.

8. An electronic apparatus comprising the electro-optical device according to claim 7.

9. A method of driving an electro-optical device, the electro-optical device having a plurality of scanning lines, a plurality of data lines divided into groups, each group having a predetermined number of data lines, a plurality of pixels disposed to correspond to intersections of the plurality of scanning lines and the plurality of data lines, image signal lines that each control a corresponding group of data lines, and a plurality of switching elements that switch between conductive states and non-conductive states of the data lines and the image signal lines, the method of driving an electro-optical device comprising:

selecting each of the plurality of scanning lines for each selection period, the selection period having a plurality of data output periods;

sequentially switching the switching elements corresponding to each group to the conductive states for each data output period of the selection period; and applying (1) a predetermined precharge voltage simultaneously to each image signal line in a precharge period prior to the plurality of data output periods of the selection period, (2) a voltage according to a gray-scale level of each pixel to each image signal line in each data output period of the selection period, (3) predetermined voltage to each image signal line in a period after the last data output period of the selection period has lapsed, and (4) the predetermined precharge voltage simultaneously to each image signal line after one selection period has lapsed, wherein the predetermined voltage is selected in advance regardless of the gray-scale level of each pixel, wherein the predetermined precharge voltage is different from the predetermined voltage, wherein the switching elements are in non-conductive states during the period after the last data output period of the selection period has lapsed such that the predetermined voltage is applied only to the image signal lines, and wherein each image signal line supplies the gray-scale voltage to a corresponding group.

* * * * *